US007800561B2

(12) United States Patent
Asano

(10) Patent No.: US 7,800,561 B2
(45) Date of Patent: Sep. 21, 2010

(54) IMAGE DISPLAY APPARATUS

(75) Inventor: Mitsuru Asano, Kanagawa (JP)

(73) Assignee: Sony Corporation, Tokyo (JP)

( * ) Notice: Subject to any disclaimer, the term of this patent is extended or adjusted under 35 U.S.C. 154(b) by 795 days.

(21) Appl. No.: 11/802,001

(22) Filed: May 18, 2007

(65) Prior Publication Data

US 2008/0079670 A1 Apr. 3, 2008

(30) Foreign Application Priority Data

May 23, 2006 (JP) ..... 2006-143328

(51) Int. Cl.
*G09G 3/30* (2006.01)

(52) U.S. Cl. ..... 345/77; 345/76

(58) Field of Classification Search ..... 345/76, 345/102, 207; 315/169.1–169.3
See application file for complete search history.

(56) References Cited

U.S. PATENT DOCUMENTS

| | | | | |
|---|---|---|---|---|
| 7,483,004 | B2 * | 1/2009 | Kim | 345/82 |
| 7,502,002 | B2 * | 3/2009 | Horiuchi et al. | 345/82 |
| 7,508,365 | B2 * | 3/2009 | Kim | 345/76 |
| 7,554,514 | B2 * | 6/2009 | Nozawa | 345/82 |
| 7,636,073 | B2 * | 12/2009 | Ono et al. | 345/76 |
| 2003/0112205 | A1 * | 6/2003 | Yamada | 345/32 |
| 2005/0140602 | A1 * | 6/2005 | Shin et al. | 345/76 |
| 2006/0066528 | A1 * | 3/2006 | Hara | 345/76 |
| 2006/0114200 | A1 * | 6/2006 | Yamashita et al. | 345/77 |
| 2007/0052644 | A1 * | 3/2007 | Uchino et al. | 345/92 |
| 2007/0091030 | A1 * | 4/2007 | Drevillon et al. | 345/76 |
| 2007/0164962 | A1 * | 7/2007 | Uchino et al. | 345/92 |
| 2007/0247399 | A1 * | 10/2007 | Yamashita et al. | 345/82 |

FOREIGN PATENT DOCUMENTS

| | | |
|---|---|---|
| JP | 2001-60076 | 3/2001 |
| JP | 2003-216100 | 7/2003 |

* cited by examiner

*Primary Examiner*—Nitin Patel
(74) *Attorney, Agent, or Firm*—Rader, Fishman & Grauer PLLC

(57) ABSTRACT

Disclosed herein is an image display apparatus, including: a plurality of scanning lines extending along rows and configured to successively supply a control signal in synchronism with a horizontal period in order to perform line-sequential scanning over one field; a plurality of signal lines extending along columns and configured to supply an image signal in accordance with the line-sequential scanning; and a plurality of pixel circuits disposed at locations at which the scanning lines and the signal lines intersect with each other and configured to form a screen.

7 Claims, 13 Drawing Sheets

IMAGE DISPLAY APPARATUS

CROSS REFERENCES TO RELATED APPLICATIONS

The present invention contains subject matter related to Japanese Patent Application JP 2006-143328 filed in the Japan Patent Office on May 23, 2006, the entire contents of which being incorporated herein by reference.

BACKGROUND OF THE INVENTION

1. Field of the Invention

This invention relates to an image display apparatus and more particularly to an image display apparatus of the active matrix type wherein electro-optical elements such as organic EL (Electro Luminescence) light emitting elements are arrayed in a matrix. The present invention relates more specifically to a screen luminance adjustment technique for a self-luminous image display apparatus.

2. Description of the Related Art

An image display apparatus of the active matrix type wherein a light emitting element such as an organic EL element is used for a pixel is known in the past and disclosed, for example, in Japanese Patent Laid-Open No. 2001-60076. The existing image display apparatus basically includes scanning lines, signal lines, and pixel circuits in order to carry out line-sequential scanning over one field. The scanning lines extend along the direction of a row and successively supply a control signal in synchronism with horizontal periods. The signal lines extend along the direction of a column and supply an image signal in accordance with the line-sequential scanning. The pixel circuits are disposed at intersecting locations of the scanning lines and the signal lines and form pixels. Each of the pixel circuits includes at least a sampling transistor, a driving transistor, a switching transistor, and an electro-optical element such as an organic EL light emitting element. The sampling transistor is rendered conducting in accordance with a control signal supplied from the associated scanning line in accordance with one horizontal period to sample an image signal supplied thereto the associated signal line. The driving transistor supplies output current in response to the sampled image signal to the electro-optical element. The electro-optical element emits light at a luminance based on the image signal with output current supplied from the driving transistor to display an image on the screen. The switching transistor is disposed on a current path along which the output current flows and carries out on and off operations in response to a different control signal supplied thereto from the scanning line. When the switching transistor is in the off state, it interrupts output current thereof, but when the switching transistor is in the on state, it supplies output current to the electro-optical element to cause the electro-optical element to emit light. The light emitting period within which any of the electro-optical elements emits light is controlled within one field in this manner to adjust the luminance level (peak luminance) of the screen.

By variably adjusting the light emitting period in this manner, the peak luminance of the screen can be controlled without varying the amplitude of the input image signal. As the light emitting period per one field increases, the light emitting amount per one field increases as much and the luminance of the screen perceived by a human being increases as much. Conversely, as the light emitting period per one field decreases, the light emitting amount per one field decreases as much and the luminance of the screen perceived by a human being decreases as much. This signifies that, where the input image signal is a digital signal, the peak luminance can be controlled without decreasing the number of gradations of the signal. Meanwhile, where the input image signal is an analog signal, since the signal amplitude does not decrease, the withstanding property against noise is high. Consequently, an image display apparatus is implemented which achieves high picture quality and allows peak luminance control.

SUMMARY OF THE INVENTION

However, the technique of turning on and off the light emitting period as described above involves a problem of flickering. As a countermeasure for eliminating this problem, a method of repeating turning on and off of a light emitting period within one field has been proposed and is disclosed, for example, in Japanese Patent Laid-Open No. 2003-216100.

On the other hand, an image display apparatus which achieves a high contrast and high picture quality while suppressing the power consumption can be provided if the peak luminance is controlled so as to be low when the average luminance level of the screen display is high but to be high when the average luminance level is low. More preferably, if the peak luminance is controlled for every variation of a field while a screen image is displayed, then the peak luminance can be controlled without proving an uncomfortable feeling to an operator of the screen image and without causing the operator to recognize the variation of the peak luminance. However, as a condition for causing the operator to fail to recognize the variation of the peak luminance, it is necessary that one adjustment step for the variation of the peak luminance by variation of the light emitting period be less than a recognition limit to the luminance variation of the human being. Image display apparatus in the past are configured without paying attention to this point, and this is a subject to be solved.

Therefore, it is demanded to provide an image display apparatus wherein the peak luminance can be controlled without allowing a variation of the peak luminance to be recognized by an operator and without providing an uncomfortable feeling to the operator.

According to an embodiment of the present invention, there is provided an image display apparatus comprising a plurality of scanning lines extending along rows and configured to successively supply a control signal in synchronism with a horizontal period in order to perform line-sequential scanning over one field, a plurality of signal lines extending along columns and configured to supply an image signal in accordance with the line-sequential scanning, and a plurality of pixel circuits disposed at locations at which the scanning lines and the signal lines intersect with each other and configured to form a screen, each of the pixel circuits including at least a sampling transistor, a driving transistor, a switching transistor and an electro-optical element, the sampling transistor being rendered conducting in response to a control signal supplied from the associated scanning line in accordance with one horizontal period to sample the image signal supplied from the associated signal line, the driving transistor supplying output current in response to the sampled image signal to the electro-optical element, the electro-optical element emitting light at a luminance according to the image signal with the output current supplied from the driving transistor to display an image on the screen, the switching transistor being disposed on a current path along which the output current flows, the switching transistor being operable to turn on and off in response to another control signal supplied from the associated scanning line such that the output current is interrupted when the switching transistor is in the off state but the output current is supplied, when the switching transistor is in the on state, to the electro-optical element so that the electro-optical element emits light, the light emitting period within which the electro-optical element emits light within one field being controlled to adjust the luminance level of the screen, the switching transistor repeating the turning on and off operations by a plural number of times in response to the control signal supplied from the associated scanning line thereby such that a plurality of light emitting periods within which the electro-optical element emits light are set divisionally within one field and which can be adjusted so as to have different time lengths.

Preferably, the switching transistor can adjust the time lengths of the light emitting periods on the real time basis while an image is displayed on the screen. In this instance, the switching transistor may adjust one of the plural light emitting periods by one adjustment unit which corresponds to one horizontal period per one field. Or, the light emitting periods may be varied to adjust the luminance level of the screen for each field, the switching transistor does not vary the time length of at least one of the plural light emitting periods.

Preferably, when the time length of any of the light emitting periods is to be adjusted, the switching transistor sets the difference between different ones of the light emitting periods within one adjustment unit which corresponds to one horizontal period. In this instance, when the time length of one of the light emitting periods is to be increased while the time lengths of the light emitting periods within one field are equal to each other, the switching transistor may preferentially increase the time length of that one of the light emitting periods which is later in time within the field. Or, when the time length of one of the light emitting periods is to be decreased while the time lengths of the light emitting periods within one field are equal to each other, the switching transistor may preferentially decrease the time length of that one of the light emitting periods which is later in time within the field.

In the image display apparatus, the switching transistor of each of the pixel circuits repeats turning on and off operations by a plural number of times in response to a control signal supplied from the associated scanning line thereby to set the light emitting period, within which the electro-optical element emits light, divisionally to a plural number of light setting periods within one field. Consequently, the luminance level of the screen can be adjusted while flickering of the screen is suppressed effectively. Further, as a characteristic feature of the present invention, the switching transistor of each of the pixel circuits can adjust the plural divisional light emitting periods such that the light lengths thereof are different from each other. Consequently, when compared with an alternative case wherein the time lengths of the divisional light emitting periods are varied collectively, the adjustment width of the luminance level is reduced, and the peak luminance control can be carried out without allowing a variation of the peak luminance to be recognized by an operator and without providing an uncomfortable feeling to the operator. Preferably, the switching transistor adjusts the time length of one of the plural divisional light emitting periods by one adjustment unit (one adjustment step) which corresponds to one horizontal period per one field. By this, the adjustment step for variation of the peak luminance by the variation of the light emitting period can be suppressed to a recognition limit of the luminance variation of a human being.

DETAILED DESCRIPTION OF THE PREFERRED EMBODIMENT

Figure 1:
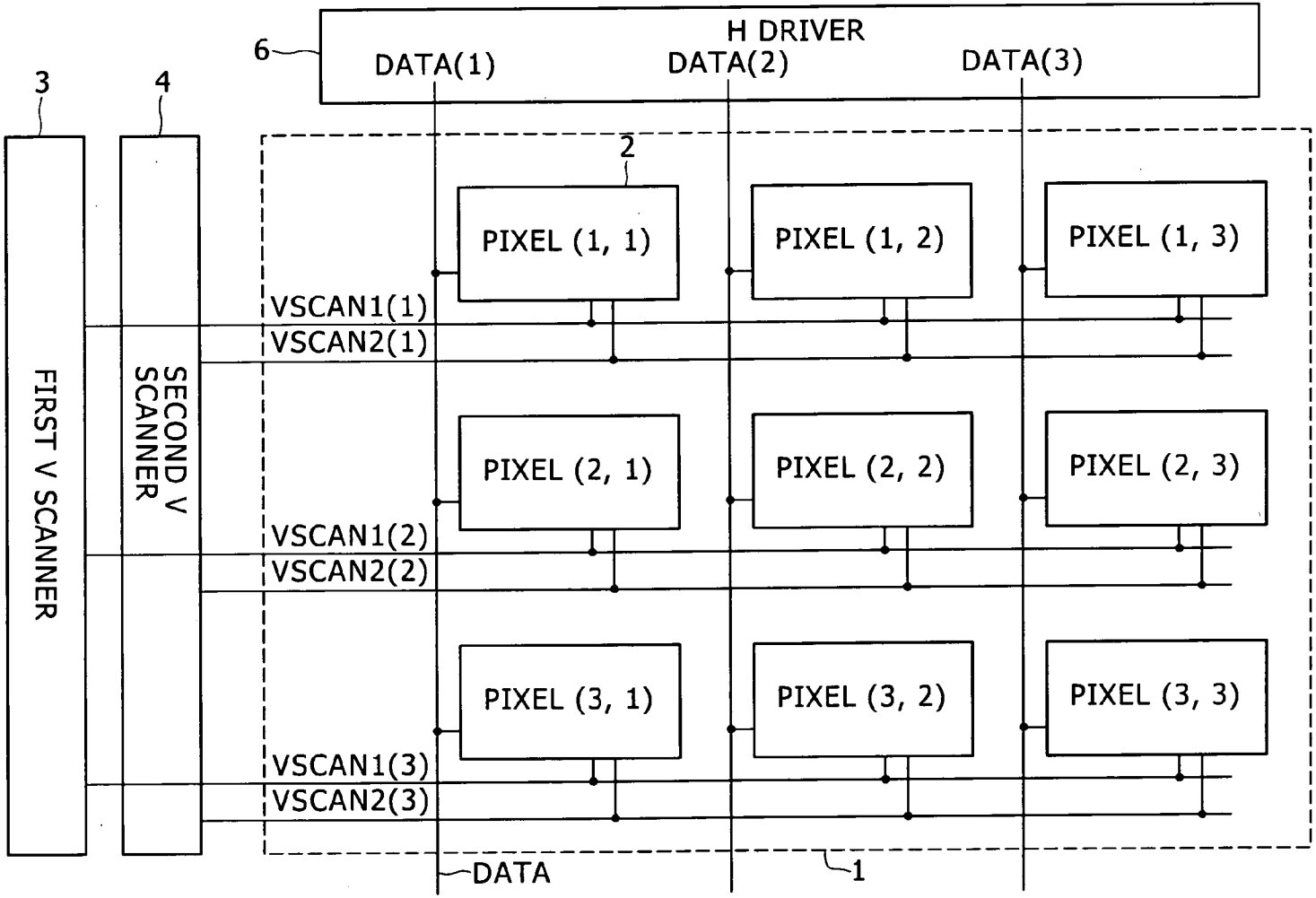
FIG. 1 is a block diagram showing a general configuration of an image display apparatus to which the present invention can be applied.

Referring to FIG. 1, there is shown a general configuration of an image display apparatus to which the present invention can be applied. The image display apparatus shown includes a screen 1. The screen 1 is formed from a set of pixels 2 disposed in rows and columns. Each of the pixels 2 is formed as a pixel circuit whose position is specified by a combination of a row number and a column number placed in parentheses. A V scanner for carrying out line-sequential scanning is disposed on a peripheral side of the screen 1. In the image display shown in FIG. 1, the V scanner is divided into a first V scanner 3 and a second V scanner 4. Meanwhile, an H driver 6 for supplying an image signal is disposed on an upper side of the screen 1.

In addition to the pixels 2 described above, scanning lines VSCAN and signal lines DATA are formed on the screen 1. The scanning lines VSCAN extend along a direction of a row and successively supply a control signal in synchronism with a horizontal period (1H) in order to perform line-sequential scanning over one field. In the image display apparatus of FIG. 1, two scanning lines are disposed for each row and are distinguished by VSCAN1 and VSCAN2. The first V scanner 3 supplies a control signal to the scanning line VSCAN1. The second V scanner 4 supplies a different control signal to the other scanning line VSCAN2. The signal lines DATA are formed along the direction of a column. The signal lines DATA are connected to the H driver 6 and supply an image signal data in accordance with line-sequential scanning of the V scanner side. Each of the pixels 2 is disposed at each of positions at which the scanning lines VSCAN and the signal lines DATA intersect with each other, and the pixels 2 form the screen 1. It is to be noted that, where the column number of each of the scanning lines VSCAN is to be designated specifically, it is indicated by parentheses. For example, one of the scanning lines of the first row is represented by VSCAN1(1) and the other scanning line of the first row is represented by VSCAN2(1).

Figure 2:
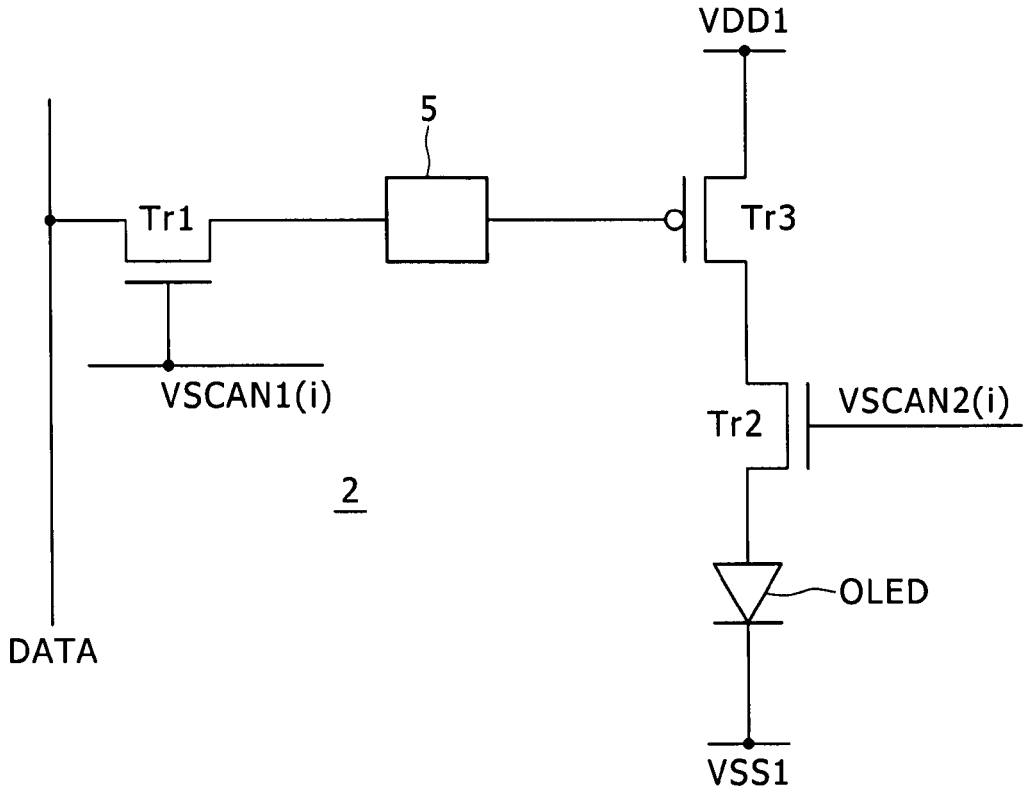
FIG. 2 is a circuit diagram showing a typical configuration of a pixel circuit included in the image display apparatus shown in FIG. 1.

FIG. 2 shows a circuit diagram showing a basic configuration of the pixel shown in FIG. 1. Referring to FIG. 2, the pixel 2 includes at least a sampling transistor Tr1, a driving transistor Tr3, a switching transistor Tr2, and an electro-optical element which may be an organic EL light emitting element OLED. An additional circuit 5 having a sampling hold function and a correction function is normally disposed between the sampling transistor Tr1 and the driving transistor Tr3. It is to be noted that, in the present specification, a circuit configuration of a pixel 2 is sometimes referred to as pixel circuit 2.

In the pixel circuit 2 shown in FIG. 2, the driving transistor Tr3 is of the P channel type and is connected at the source thereof to a power supply line VDD1 and at the drain thereof to the anode of the organic EL light emitting element OLED through the switching transistor Tr2. The cathode of the organic EL light emitting element OLED is connected to a ground line VSS1. The gate of the switching transistor Tr2 is connected to the scanning line VSCAN2. Meanwhile, the sampling transistor Tr1 is connected at one end thereof to the signal line DATA and at the other end thereof to the gate of the driving transistor Tr3 through the additional circuit 5. The gate of the sampling transistor Tr1 is connected to the scanning line VSCAN1.

The sampling transistor Tr1 conducts in response to a control signal supplied thereto from the scanning line VSCAN1(i) in accordance with one horizontal period to sample an image signal supplied from the signal line DATA. The sampled image signal is held by the additional circuit 5. The driving transistor Tr3 supplies output current in accordance with the image signal held in the additional circuit 5 to the organic EL light emitting element OLED. In particular, the driving transistor Tr3 operates in a saturation region, and receives, at the gate thereof, an input voltage according to the sampled image signal and supplies drain current in accordance with the input voltage as output current to the organic EL light emitting element OLED. While the driving transistor Tr3 operates in the saturation region, the drain current flows between the source and the drain in response to the gate voltage applied between the gate and the source. The organic EL light emitting element OLED emits light at a luminance according to the image signal in accordance with the output current supplied from the driving transistor Tr3 to display a desired image on the screen 1. The switching transistor Tr2 is disposed in the current path along which the output current described above flows. While, in the pixel circuit 2 shown in FIG. 2, the switching transistor Tr2 is interposed between the driving transistor Tr3 and the organic EL light emitting element OLED, according to an embodiment of the present invention, the location of the switching transistor Tr2 is not limited to this. The output current path is usually formed from the power supply line VDD1 to the ground line VSS1, and the switching transistor Tr2 is located at a suitable position between the power supply line VDD1 and the ground line VSS1. The switching transistor Tr2 carries out on and off operations in response to a control signal supplied thereto from the scanning line VSCAN2(i). When the switching transistor Tr2 is in an off state, it interrupts the output current, but when the switching transistor Tr2 is in an on state, it supplies the output current to the organic EL light emitting element OLED so that the light emitting element OLED may emit light. Consequently, the light emitting period within which the light emitting element OLED emits light within one field can be controlled to adjust the luminance level (peak luminance) of the screen 1.

As a characteristic feature of the pixel circuit 2 shown in FIG. 2, the switching transistor Tr2 repeats on and off operations by a plural number of times in response to a control signal supplied from the scanning line VSCAN2(i). Thus, the light emitting period within which the light emitting element OLED emits light is set divisionally for a plural number of times, and besides, the divisional light emitting periods are adjusted so that they have different time lengths. Preferably, the switching transistor Tr2 can adjust the time length of the light emitting period on the real time basis while an image is displayed on the screen 1. In this instance, the switching transistor Tr2 adjusts the time length of one divisional light emitting period from among the divisional light emitting periods by one adjustment unit (adjustment step) corresponding to one horizontal period (1H) for each one field. When the light emitting period is varied for each one field to adjust the luminance level of the screen, the switching transistor Tr2 adjusts the light emitting period such that at least one of the plural divisional light emitting periods may maintain the time length thereof. Furthermore, when the time length of the light emitting period is adjusted, the switching transistor Tr2 adjusts the time length such that the difference between time lengths of different ones of the divisional light emitting periods may be within one adjustment unit (one adjustment step) which corresponds to one horizontal period (1H). In this instance, when the time length of one of the divisional light emitting periods is to be increased while time length of divisional light emitting periods within one field are equal to each other, the time length of that one of the divisional light emitting periods in one field which is later in time is increased preferentially. On the contrary, when the time length of one of the divisional light emitting periods is to be decreased, the time length of that one of the divisional light emitting periods in one field which is later in time is decreased preferentially.

Figure 3:
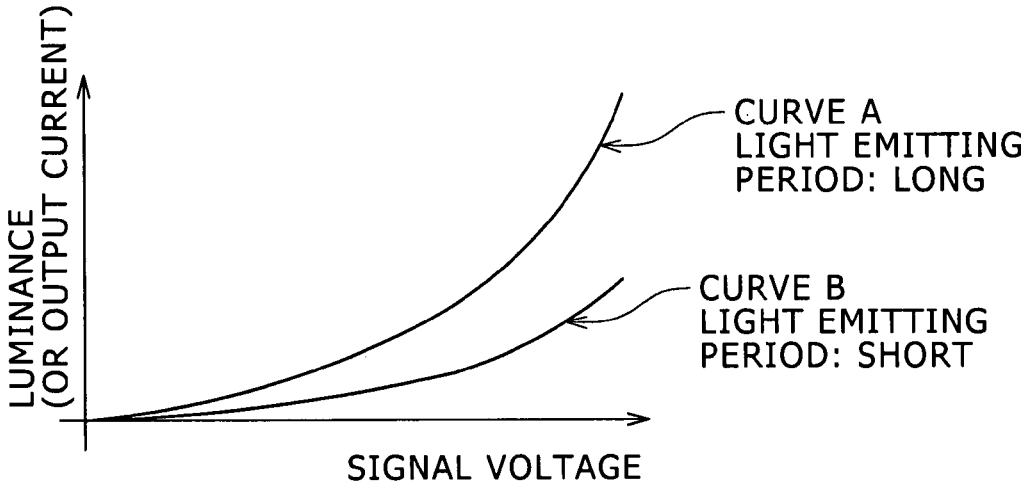
FIG. 3 is a graph illustrating a relationship between the luminance of a screen and the signal voltage.

FIG. 3 illustrates a relationship between the luminance of the screen formed from a set of light emitting elements and the signal voltage of the input image signal. In other words, FIG. 3 illustrates a relationship between the output current supplied from the driving transistor and the signal voltage of the input image signal. Referring to FIG. 3, a characteristic curve A illustrates the relationship where the light emitting period is set comparatively long while another characteristic curve B illustrates the relationship where the total light emitting period within one field is set comparatively short. In both cases, the luminance increases as the output current increases. In this instance, the overall luminance level where the light emitting period is comparatively long is higher than that where the light emitting period is comparatively short. In this manner, according to the image display apparatus, the luminance level (peak luminance) of the screen can be adjusted freely by adjusting the light emitting period within one field. By such adjustment, also a fade-in feature wherein the light emitting period is gradually increased and a fade-out feature wherein the light emitting period is gradually degreased can be achieved.

Figure 4A:
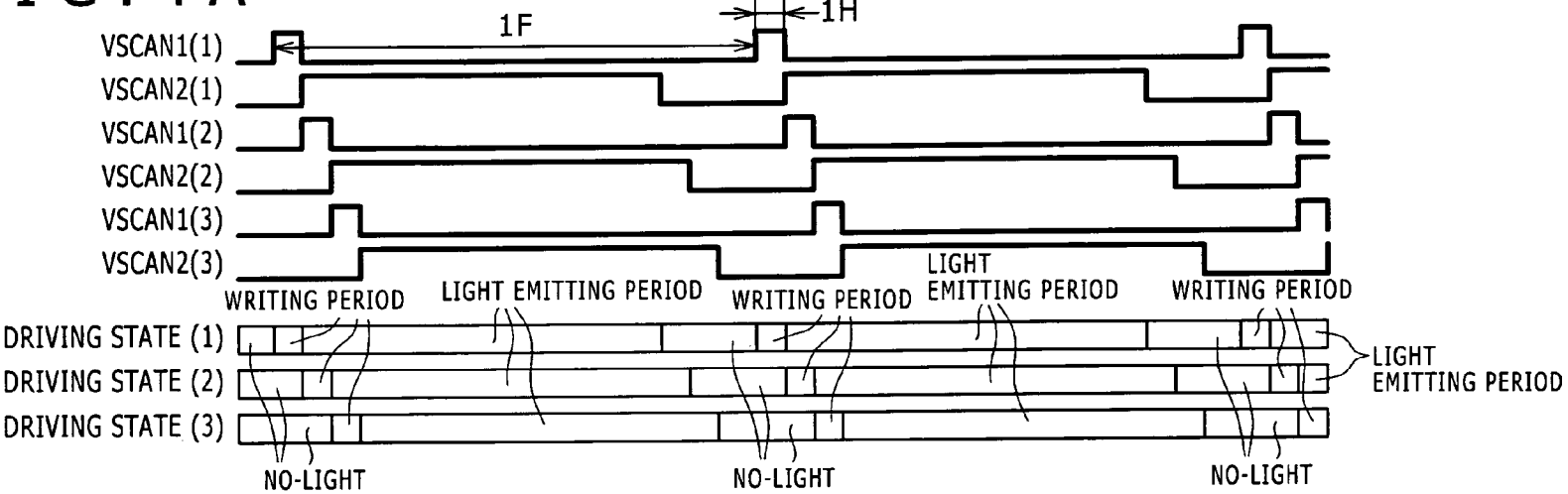
FIGS. 4A and 4B are timing charts illustrating an example for reference of operation of the image display apparatus of FIG. 1.
Figure 4B:
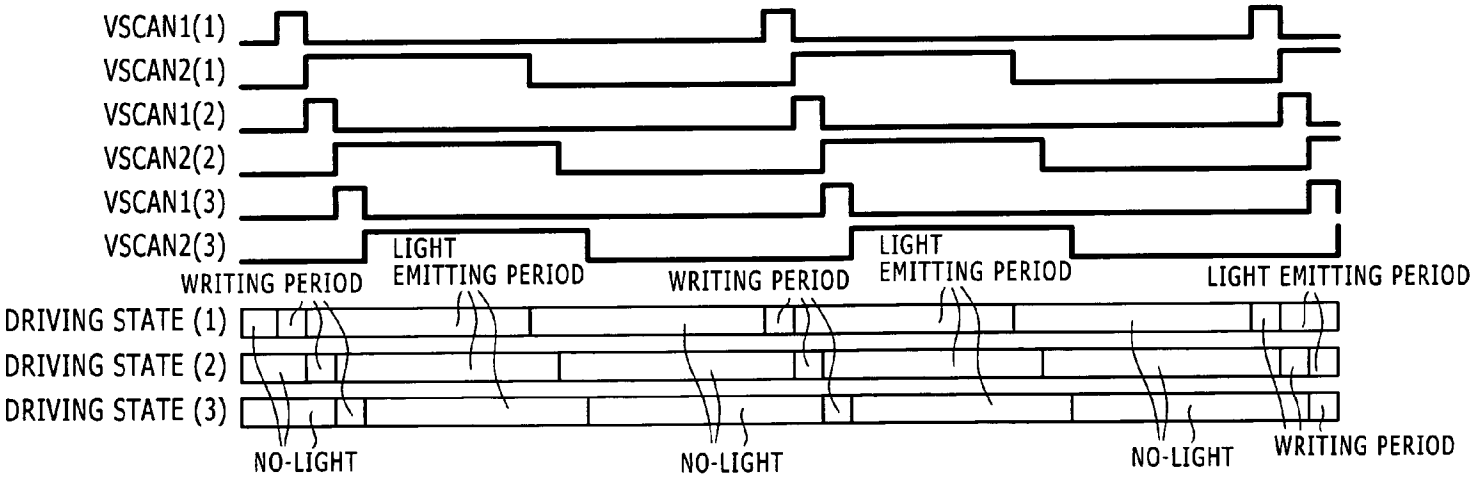

FIGS. 4A and 4B illustrate operation of the image display described above with reference to FIGS. 1 and 2. It is to be noted that the timing charts of FIGS. 4A and 4B illustrate operation where the number of times of light emitting periods is set to one within one field. Although such setting is not preferable because flickering is observed conspicuously, in order to facilitate understandings of the present invention, the operation of FIGS. 4A and 4B is described in detail as an example for reference. The timing chart of FIG. 4A illustrates operation where the light emitting period is set comparatively long while the timing chart of FIG. 4B illustrates operation where the light emitting period is set comparatively short. In FIG. 4A, the control signals VSCAN1 and VSCAN2 successively applied to the first, second and third rows of the pixels and driving conditions of the pixels which operate in response to the control signals VSCAN1 and VSCAN2 are represented on the same time axis. In the following description, in order to facilitate description, the scanning lines and corresponding control signals are represented by common reference characters. The row numbers are distinguished using numbers in parentheses. For example, VSCAN1(1) represents a control signal applied to the gate of the sampling transistor Tr1 of a pixel on the first row. Meanwhile, VSCAN2(1) represents a control signal to be applied to the gate of the switching transistor of a pixel circuit on the same first row and designates the light emitting period. The driving state (1) represents a driving state of a pixel circuit on the first row according to the control signals VSCAN1(1) and VSCAN2(1) and is divided into a writing period, light emitting period and a no-light emitting period. Within the writing period, the sampling transistor samples the image signal in response to the control signal VSCAN1, within light emitting period, the switching transistor is in an on state in response to VSCAN2 and the light emitting element emits light, and within the no-light emitting period, the switching transistor is in an off state and the light emitting element emits no light.

As seen from the timing chart of FIG. 4A, the control signal VSCAN1 is line-sequentially scanned for every row, and the pixel circuits sample an image for every row. The writing period allocated to each row corresponds to one horizontal period (1H). Another control signal VSCAN2 is line-sequentially scanned for every row similarly and the pixel circuits of the rows are successively placed into a light emitting period. When the control signal VSCAN2 changes over from the high level to the low level, the light emitting element enters a no-light emitting period from a light emitting period. By such field operations are repeated, the image on the screen is successively rewritten to display a desired moving picture. As apparent seen from FIG. 4A, one light emitting period is included in one field while the remaining period is a no-light emitting period. The light emitting period can be controlled with the period within which the control signal VSCAN2 has the high level. The timing chart of FIG. 4A illustrates operation where the period within which the control signal VSCAN2 has the high level (such period may be hereinafter referred to simply as pulse width) is comparatively long, and in this instance, the light emitting period is long as much. Accordingly, the luminance level (peak luminance) of the screen is high. It is to be noted that the waveform of the control signal VSCAN2 is produced by successively transferring a start pulse supplied from the outside in advance using a shift register. The light emitting period can be adjusted freely by varying the waveform of the start pulse. Thereupon, since the shift register is reset after the line-sequential scanning thereof is completed once in one field, the timing at which the waveform of start pulse is updated is an end of each field. In other words, the light emitting period can be adjusted once within one field. Since the shift register transfers the start pulse in response to a clock signal of a 1H period, the resolution thereof normally is 1H or n (n=1, 2, 3, . . . ) times of 1H. Therefore, one adjustment unit (one adjustment step) of the light emitting period is one horizontal period (1H) or n times (n=1, 2, 3, . . . ) the one horizontal period. The description here is given with regard to a case where n=1.

The timing chart of FIG. 4B is basically same as the timing chart of FIG. 4A. However, in the timing chart of FIG. 4B, the pulse width of the control signal VSCAN2 which defines the light emitting period is reduced. The light emitting period within one field decreases as much while the no-light emitting period increases as much. Since the light emitting period decreases, the luminance level of the screen decreases as much.

Figure 5:
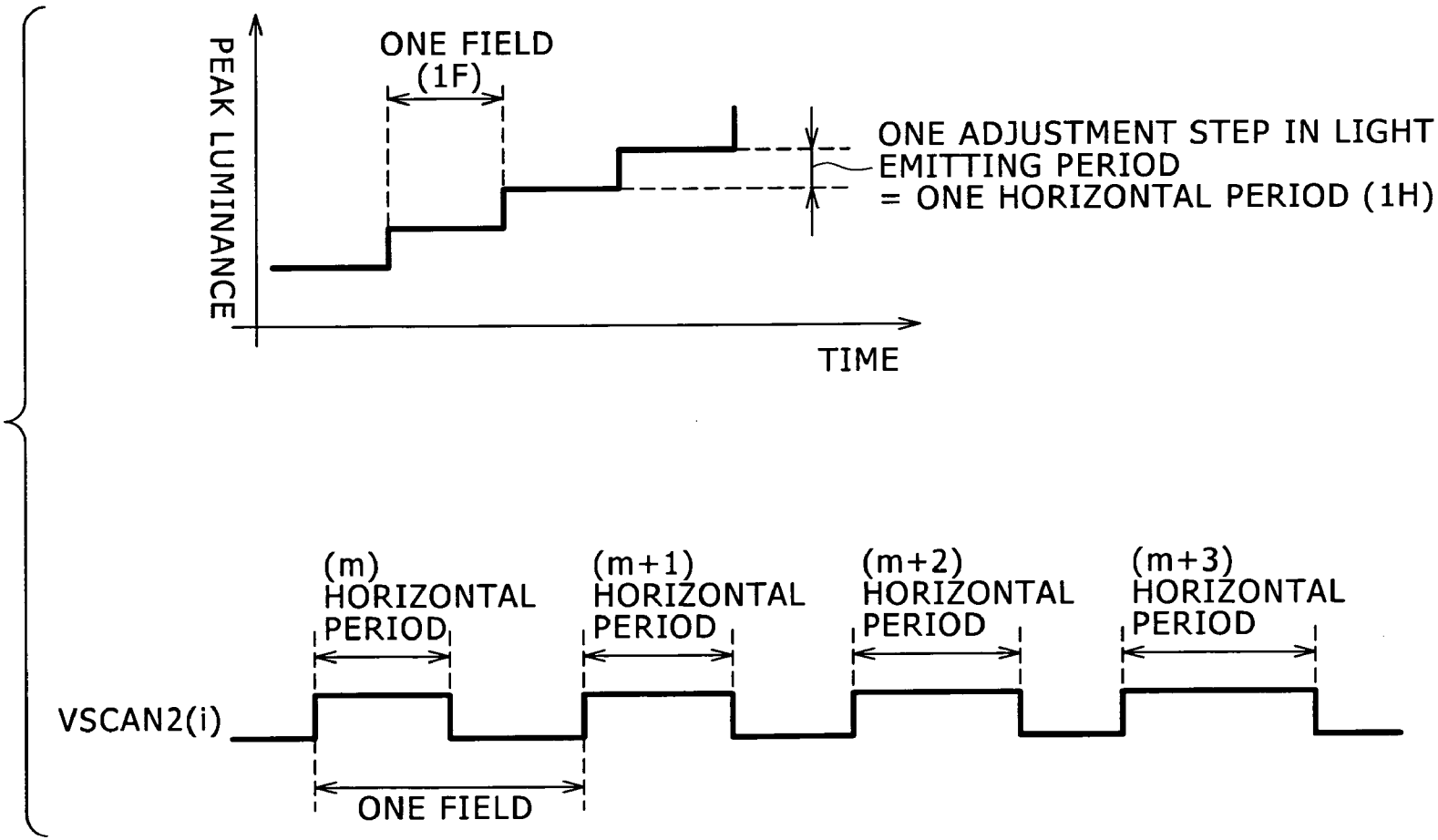
FIG. 5 is a diagrammatic view illustrating real time adjustment of the peak luminance in the image display apparatus of FIG. 1.

FIG. 5 illustrates real time adjustment of the peak luminance. Referring to FIG. 5, the graph shown illustrates a relationship between the peak luminance and the elapsed time. As described hereinabove, the present image display allows adjustment of the screen luminance level with an adjustment step width of one horizontal period (1H) once per one field (1F). In the adjustment illustrated in FIG. 5, the peak luminance is successively increased one by one step for each one field.

In this instance, the control signal VSCAN2(i) applied to the gate of the switching transistor has such a waveform that the pulse width successively increases by 1H for each one field. In the example illustrated in FIG. 5, the pulse width in the first field is m horizontal periods, and the pulse width in the next field increases to m+1 horizontal periods. The pulse width in the further next field increases to the m+2 horizontal periods. Together with such increase of the pulse width, the light emitting period successively increases by 1H for every one field. If the adjustment is stopped when a peak luminance suitable for the screen display is just reached, then an optimum screen luminance level is obtained.

Figure 6A:
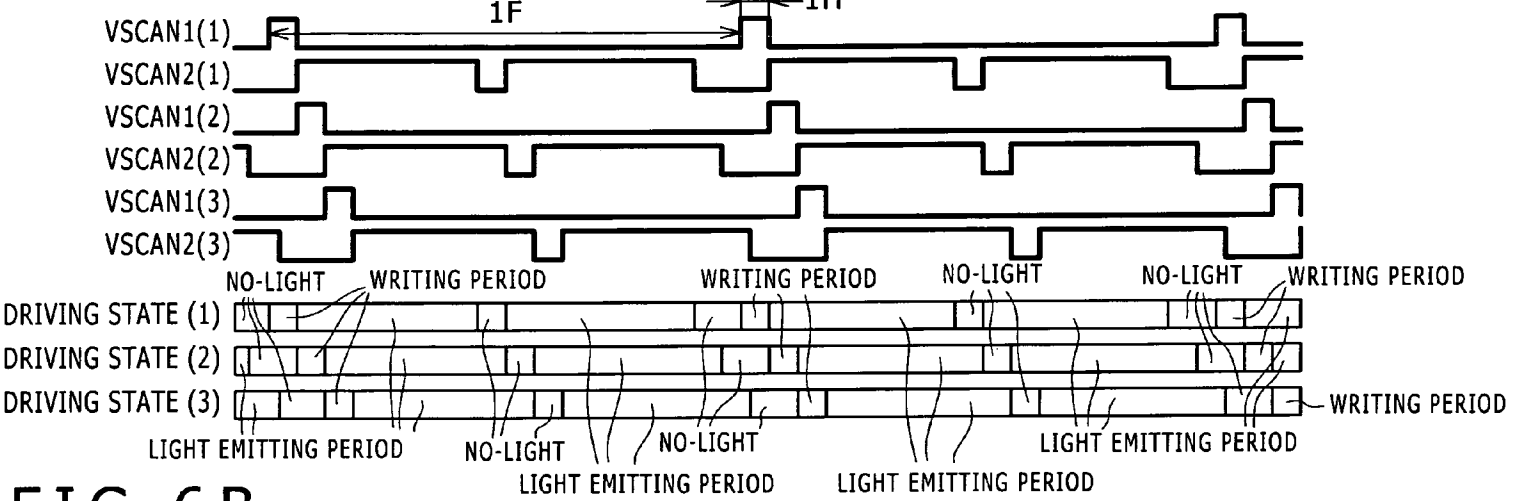
FIGS. 6A and 6B are timing charts illustrating another example for reference of operation of the image display apparatus of FIG. 1.
Figure 6B:
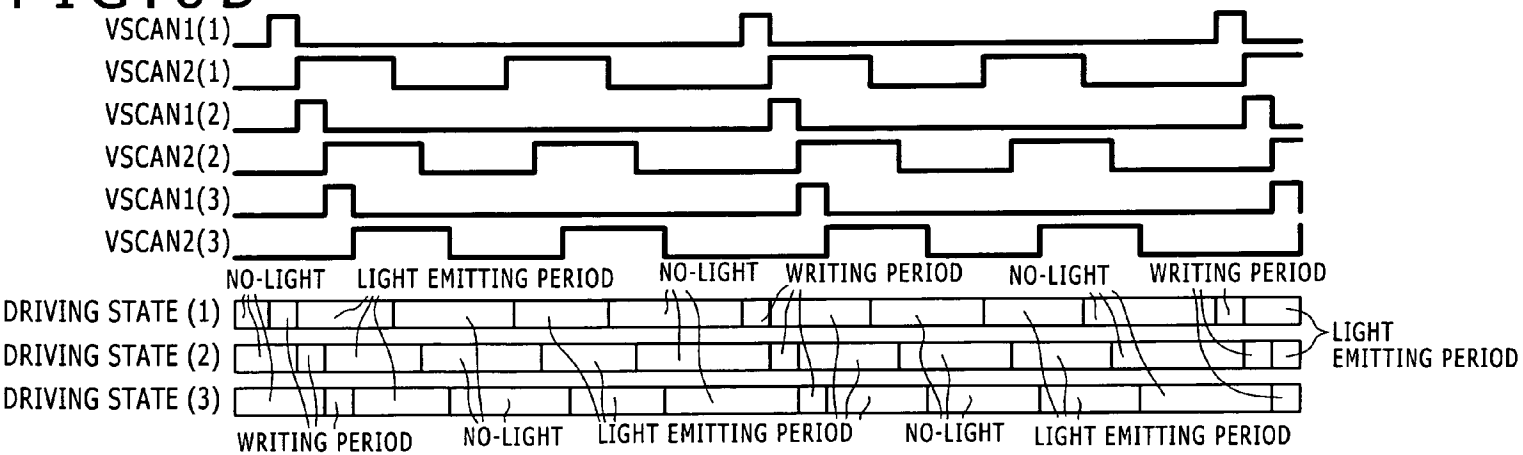

FIGS. 6A and 6B illustrate another example for reference. In order to facilitate understandings, the same representation as that of the timing charts of the first reference example shown in FIGS. 4A and 4B is adopted also in FIGS. 4A and 4B. FIG. 6A illustrates operation when the light emitting period is comparatively long while FIG. 6B illustrates operation when the light emitting period is comparatively short. In both cases, one field (1F) includes two light emitting periods. In other words, the control signal VSCAN2 includes two pulses within one field (1F). The switching transistor repeats on and off operations twice in response to the control signal VSCAN2 to divide the light emitting period into two divisional light emitting periods. This decreases flickering.

As can be apparently seen from comparison between the timing charts of FIGS. 6A and 6B, in the adjustment of the light emitting period, an equal time width is adjusted within the two preceding and succeeding light emitting periods. Accordingly, since the minimum adjustment width appears once within one light emitting period and hence appears twice within one field, the minimum adjustment width for each one field is 2H.

Figure 7:
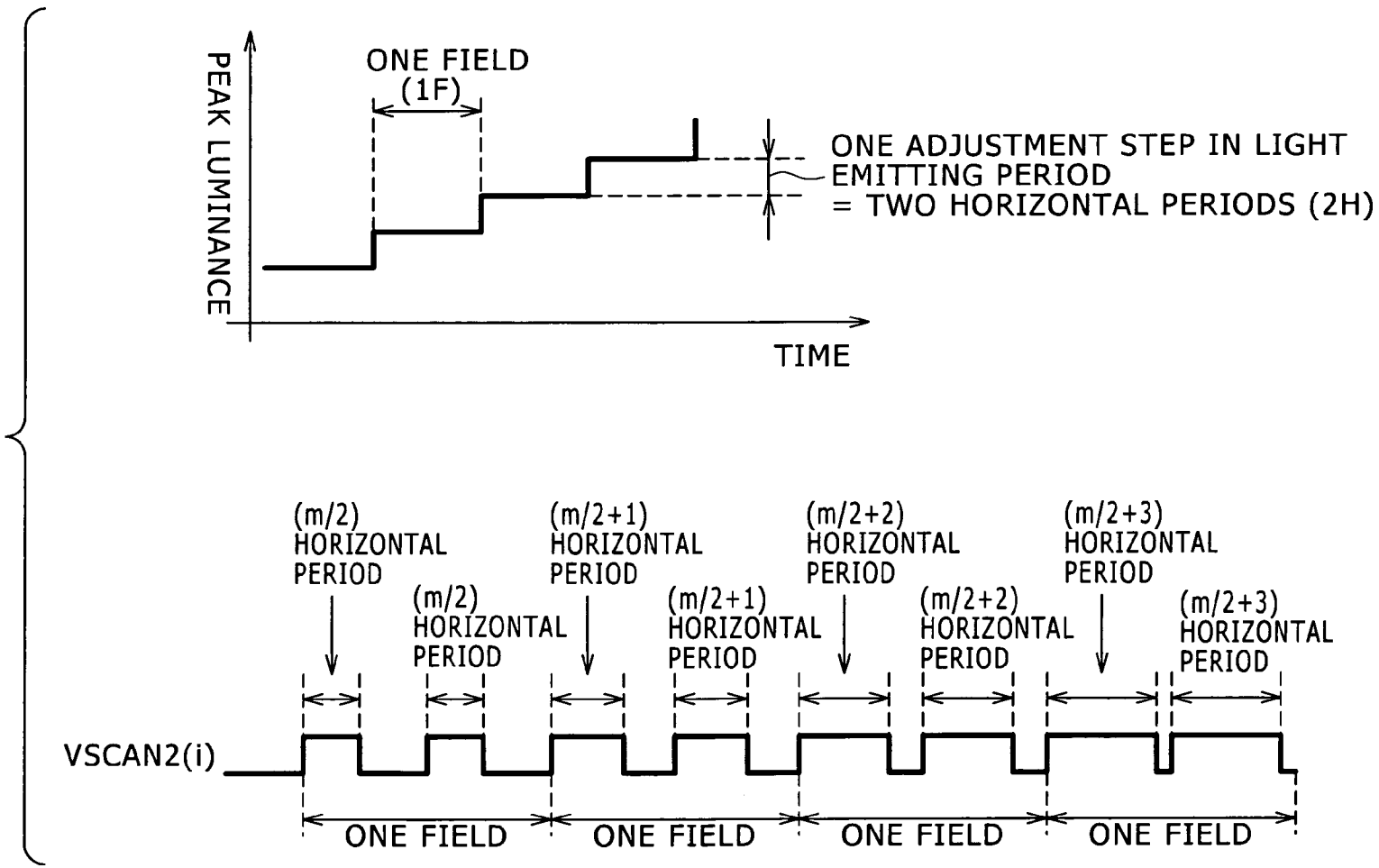
FIG. 7 is a diagrammatic view illustrating the relationship between the peak luminance and the elapsed time in the image display apparatus of FIG. 1.

FIG. 7 illustrates a relationship between the peak luminance and the elapsed time in the example for reference illustrated in FIGS. 6A and 6B. In the example for reference of FIGS. 6A and 6B, the peak luminance can be variably adjusted by an amount corresponding to two horizontal periods (2H) for every one field. Usually, in screen adjustment, it is preferable to carry out peak luminance control without causing the operator to recognize any variation of the peak luminance and have no uncomfortable feeling. As a condition for preventing the operator from recognizing the variation of the peak luminance, it is necessary that one adjustment step in variation of the peak luminance by variation of the light emitting period be less than a recognition limit of the luminance variation of a human being. In the case of the example for reference of FIG. 7, one adjustment step is 2H. This width sometimes exceeds the recognition limit of the luminance variation of a human being. Accordingly, when the peal luminance control is performed on the real time basis, a variation of the peak luminance is sometimes recognized for each field, and there is the possibility that the operator may have an uncomfortable feeling. A waveform of the control signal VSCAN2(i) which defines the light emitting period is shown on the lower side in FIG. 7. First in one field, both of the two preceding and succeeding light emitting periods are m/2 horizontal periods. It is to be noted that, in the following description, m is an even number. In the next one field, both of the two preceding and succeeding light emitting periods increase by one 1H. Accordingly, the totaling light emitting period in one field is longer by 2H. Since, in the case of the example for reference of FIGS. 6A and 6B, the totaling light emitting period increases in a unit of 2H for one field, the operator may sometimes have an uncomfortable feeling because of the real time adjustment of the peak luminance.

Figure 8:
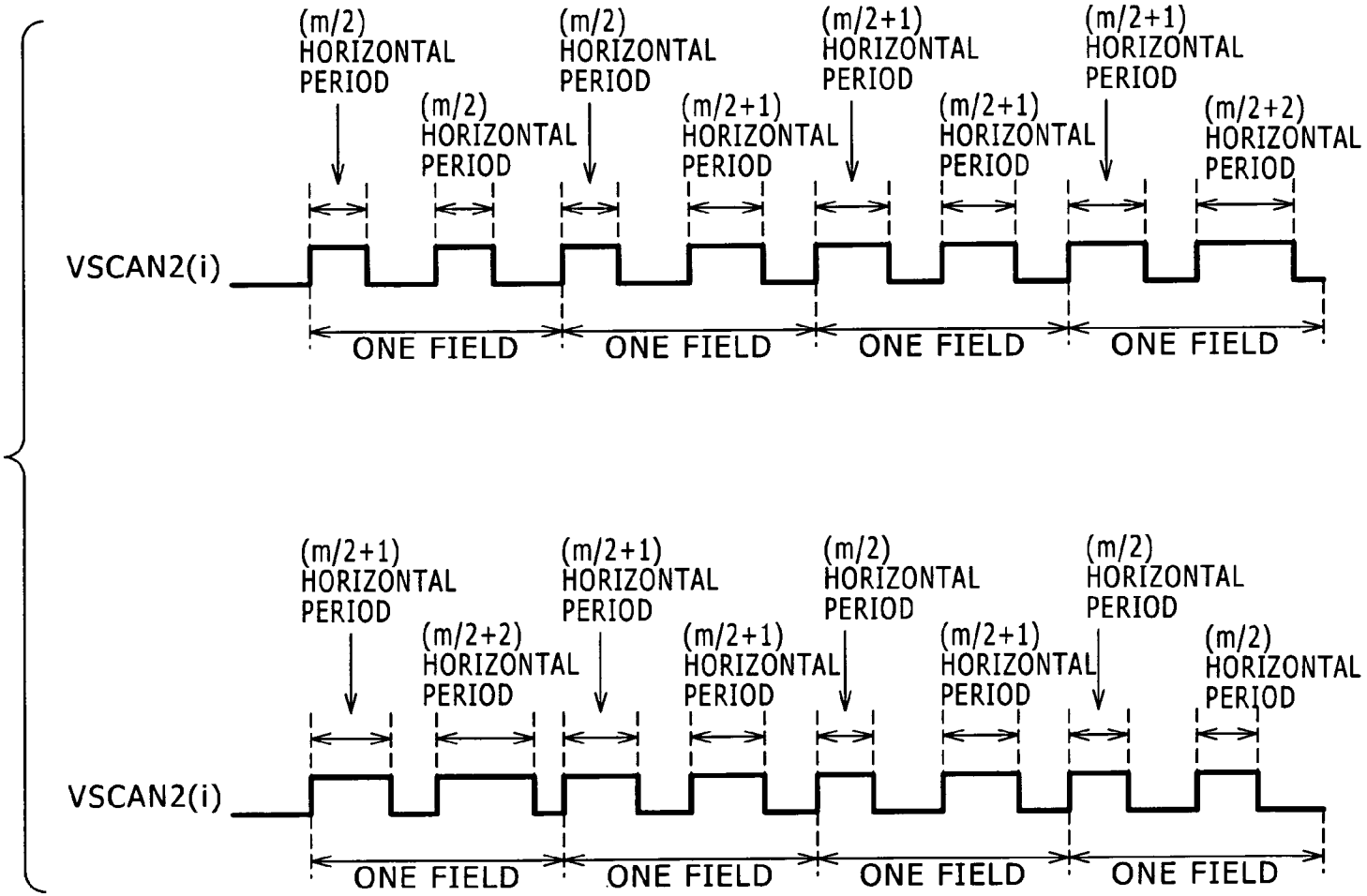
FIGS. 8 and 9 are timing charts illustrating different manners of operation of an image display apparatus according to an embodiment of the present invention.

FIG. 8 shows a waveform illustrating a manner of operation of an image display apparatus according to an embodiment of the present invention. A waveform diagram on the upper side in FIG. 8 represents the waveform of the control signal VSCAN2(i) where the light emitting period increases while another waveform diagram on the lower side in FIG. 8 represents the waveform of the control signal VSCAN2(i) where the light emitting period decreases. When the light emitting period is to be increased, as can seen from the waveform diagram on the upper side in FIG. 8, only one of two preceding and succeeding light emitting periods included in one field increases by 1H. By adjusting the waveform of the control signal VSCAN2 in this manner, the light emitting period can be increased by one adjustment unit for every one field. Similarly, also when the light emitting period is to be decreased, only one of two preceding and succeeding light emitting periods included in one field is decreased by one adjustment unit. In this manner, in the image display apparatus according to an embodiment of the present invention, where a plurality of light emitting periods are included in one field, the adjustment step within one field can be set to 1H of the minimum unit by varying the time length of only one of the light emitting periods. By such setting, peak luminance control can be carried out without providing an uncomfortable feeling to the operator while the screen is displayed.

Figure 9:
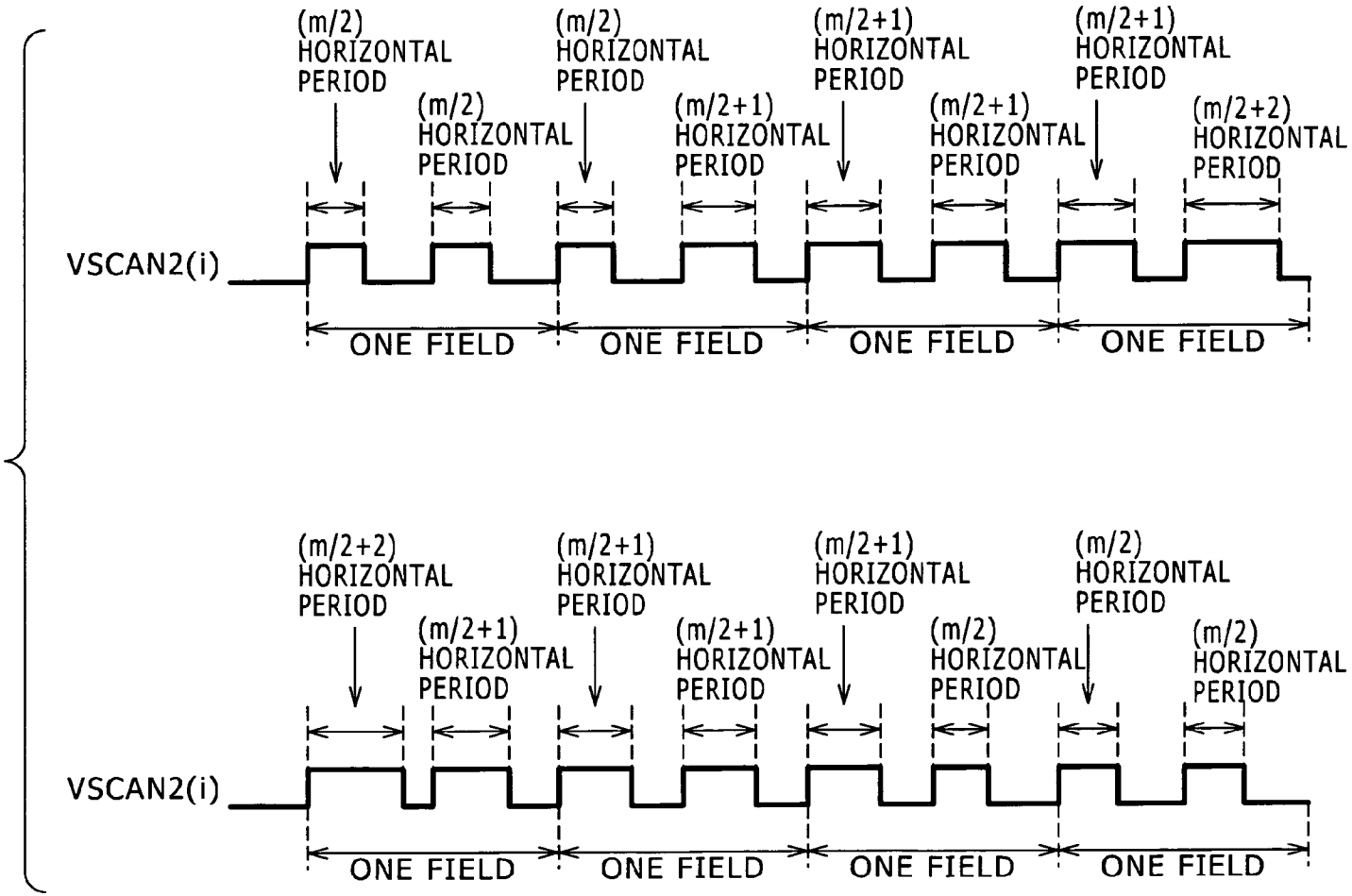

FIG. 9 shows a waveform illustrating a different manner of operation of the image display apparatus according to an embodiment of the present invention. In order to facilitate understandings, similar representation as that of the waveform diagram of FIG. 8 which illustrates the first-mentioned manner of operation of the image display apparatus according to an embodiment of the present invention is adopted also in FIG. 9. A waveform diagram on the upper side in FIG. 9 represents the waveform of the control signal VSCAN2(i) where the light emitting period increases while the waveform diagram on the lower side in FIG. 9 represents the waveform of the control signal VSCAN2(i) where the light emitting period decreases. In both cases, a plurality of light emitting periods are included in one field similarly as in the manner of operation illustrated in FIG. 8. In the manner of operation illustrated in FIG. 9, the time length of only one of the divisional light emitting periods is successively varied stepwise for each field. The present manner of operation is further preferable in that, also where the variation of the light emitting period not only within one field but also between adjacent fields is considered, the adjustment step of the light emitting luminance is small. In particular, where the light emitting period is to be increased when a plurality of divisional light emitting periods within one field are equal, the light emitting period which is later in time from among the plural divisional light emitting periods within one field is increased preferentially. Conversely, where the light emitting period is to be decreased when a plurality of divisional light emitting periods within one field are equal, the light emitting period which is later in time from among the plural light emitting periods within one field is decreased preferentially. By such variation of the light emitting period, peak luminance control can be carried out without providing an uncomfortable feeling to the operator while the screen is displayed.

It is to be noted that, while, in the first and second manners of operation described above, two light emitting periods are included in one field, the number of such light emitting periods may otherwise be three. In this instance, when the light emitting period is to be varied, one of the three light emitting periods within one field may be varied or two of the three light emitting periods within one period may be varied. Where the number of light emitting periods to be varied is small, luminance variation which is less likely to provide an uncomfortable feeling can be implemented. However, if the number of light emitting periods to be varied is increased within a range within which the variation does not provide an uncomfortable feeling, then the response speed of the luminance variation can be raised.

Figure 10:
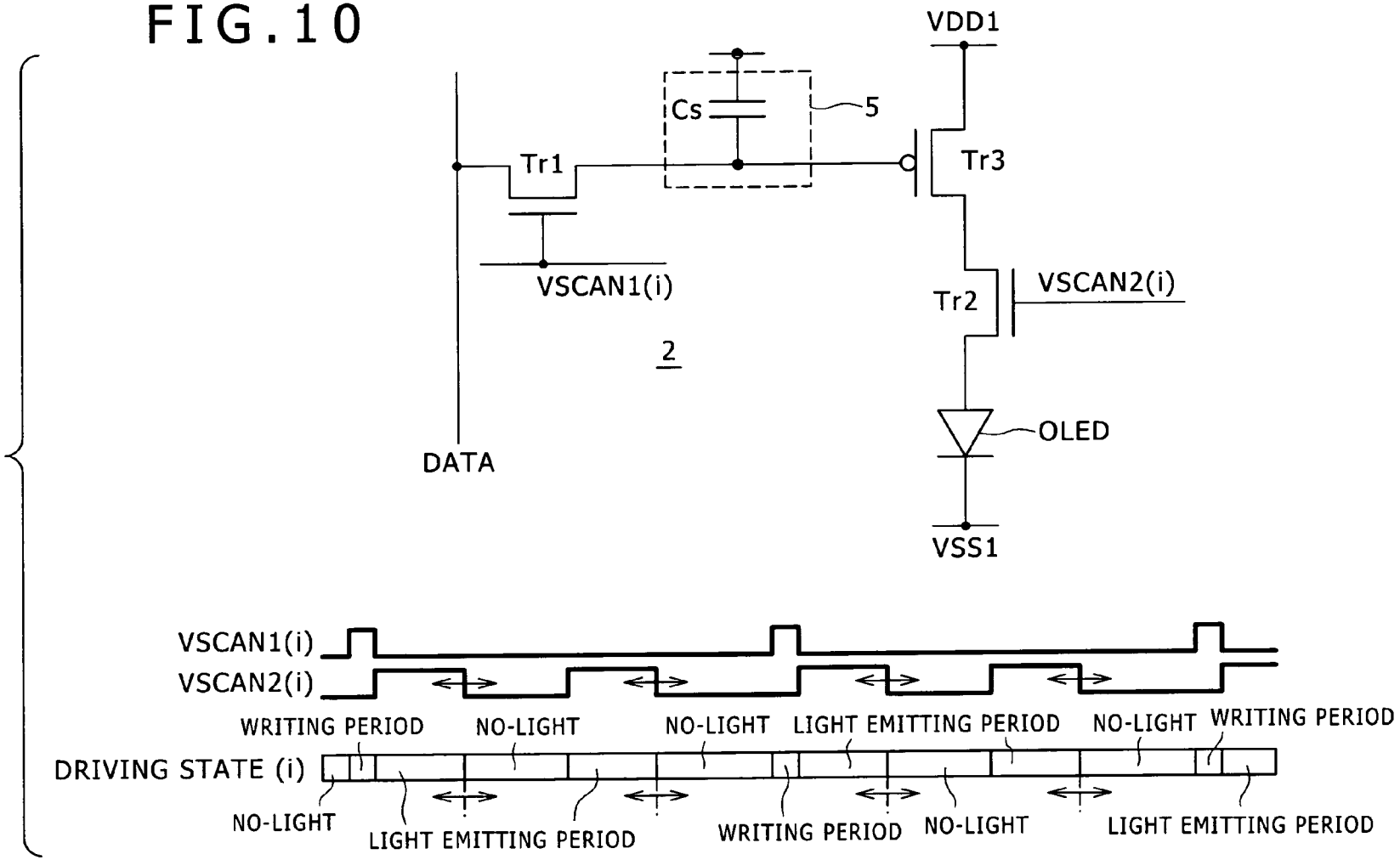
FIGS. 10 to 14 are diagrammatic views showing different pixel circuits incorporated in the image display apparatus according to an embodiment of the present invention.

FIG. 10 is a circuit diagram showing an example of a particular configuration of the additional circuit 5 included in the pixel circuit shown in FIG. 2. The example of the additional circuit 5 shown in FIG. 10 has a very simple configuration and includes a single pixel capacitor Cs. The pixel capacitor Cs is connected at one end thereof to the power supply line VDD1 and at the other end thereof to the gate of the driving transistor Tr3.

FIG. 10 shows, on the lower side thereof, a timing chart illustrating operation of the pixel circuit 2 shown in FIG. 10. The timing chart illustrates control signals VSCAN1(i) and VSCAN2(i) to be applied to the pixel circuit 2 of the ith row and the driving state of the pixel circuit 2 of the ith row on the same time axis. The driving state (i) of the pixel circuit in the ith row includes a writing period, a light emitting period and a no-light emitting period. This is basically same as that of the timing charts illustrated in FIGS. 6A and 6B.

When the control signal VSCAN1(i) changes over to the high level, the sampling transistor Tr1 is turned on to sample an image signal supplied from the signal line DATA, and the sampled image signal is held into the pixel capacitor Cs. This is performed within the writing period. Thereafter, a first pulse of the control signal VSCAN2(i) is applied to the gate of the switching transistor Tr2 to enter a first light emitting period. Then, a second pulse of the control signal VSCAN2(i) is applied to the gate of the switching transistor Tr2 to enter a second light emitting period. The pixel circuit 2 shown in FIG. 10 divides one field into two light emitting periods in this manner. Within each divisional light emitting period, the driving transistor Tr3 supplies output current corresponding to the image signal retained in the pixel capacitor Cs to the light emitting element OLED. As apparent from the foregoing description, the additional circuit 5 shown in FIG. 10 has a function of merely sampling and holding an image signal.

Figure 11:
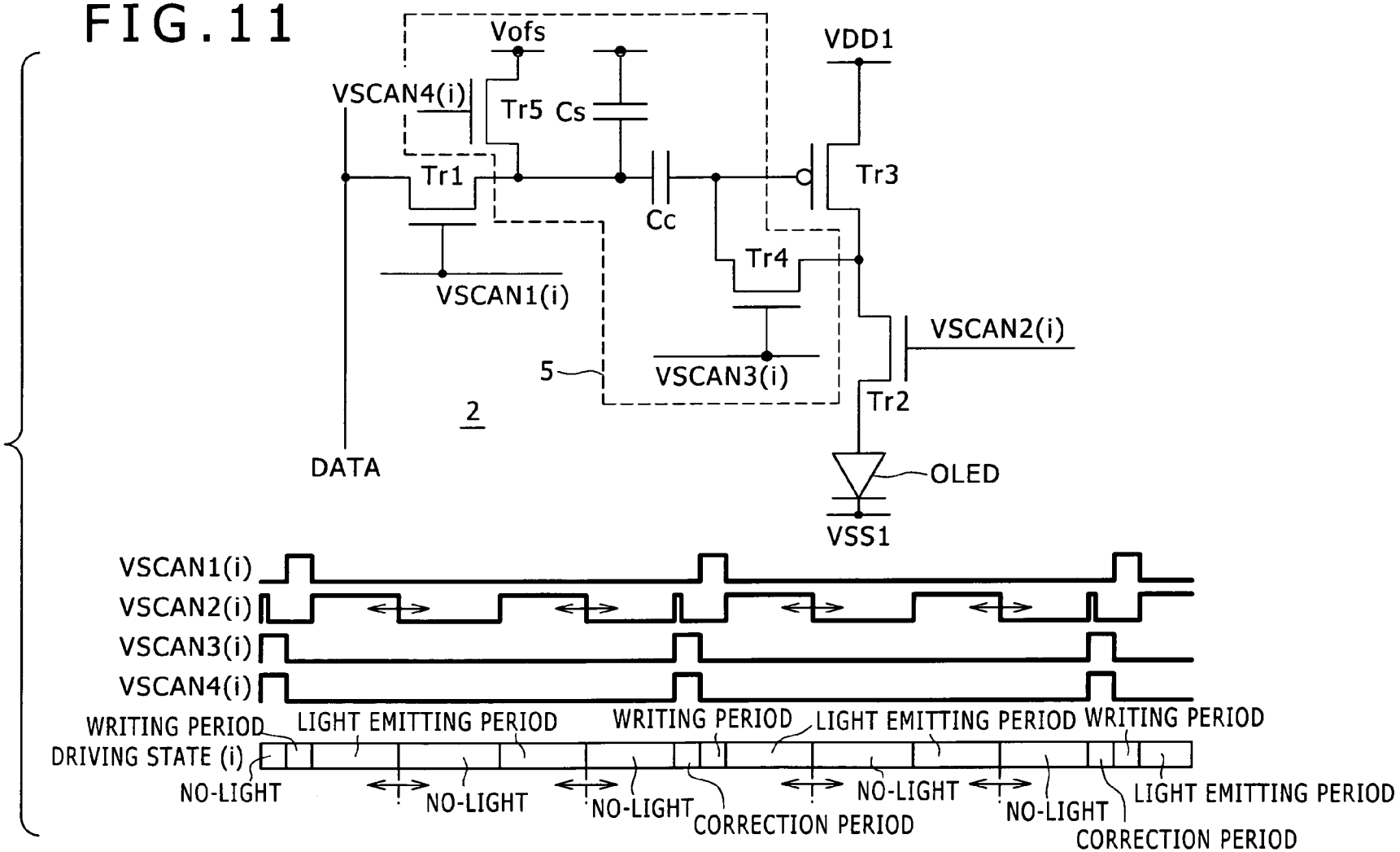

FIG. 11 shows a second form of the pixel circuit. In order to facilitate understandings, representation same as that of the first form shown in FIG. 10 is adopted also in FIG. 11, and a circuit diagram is shown on the upper side while a timing chart is shown on the lower side in FIG. 11. As seen in FIG. 11, the additional circuit 5 of the pixel circuit 2 has a more complicated configuration than the additional circuit 5 shown in FIG. 10 and additionally includes switching transistors Tr4 and Tr5 and a coupling capacitor Cc. The switching transistor Tr4 is inserted between the gate and the drain of the driving transistor Tr3, and a different control signal VSCAN3(i) is applied to the gate of the switching transistor Tr4. The switching transistor Tr5 is connected to a predetermined offset potential Vofs and an end of the pixel capacitor Cs, and another different control signal VSCAN4(i) is applied to the gate of the switching transistor Tr5. The coupling capacitor Cc is inserted between one end of the pixel capacitor Cs and the gate of the driving transistor Tr3.

As seen from the timing chart of FIG. 11, the driving state of the pixel circuit 2 includes a correction period in addition to a writing period, a light emitting period and a no-light emitting period described hereinabove in connection with the first form of the pixel circuit 2. The correction period is started when the control signals VSCAN2(i), VSCAN3(i) and VSCAN4(i) exhibit the high level. Within the correction period, a threshold value of the driving transistor Tr3 is detected and written into the pixel capacitor Cs. By this, a dispersion of the threshold value of the driving transistor Tr3 can be canceled. In other words, the pixel circuit 2 shown in FIG. 11 is of the voltage writing type and incorporates a threshold voltage correction function of the driving transistor Tr3.

Figure 12:
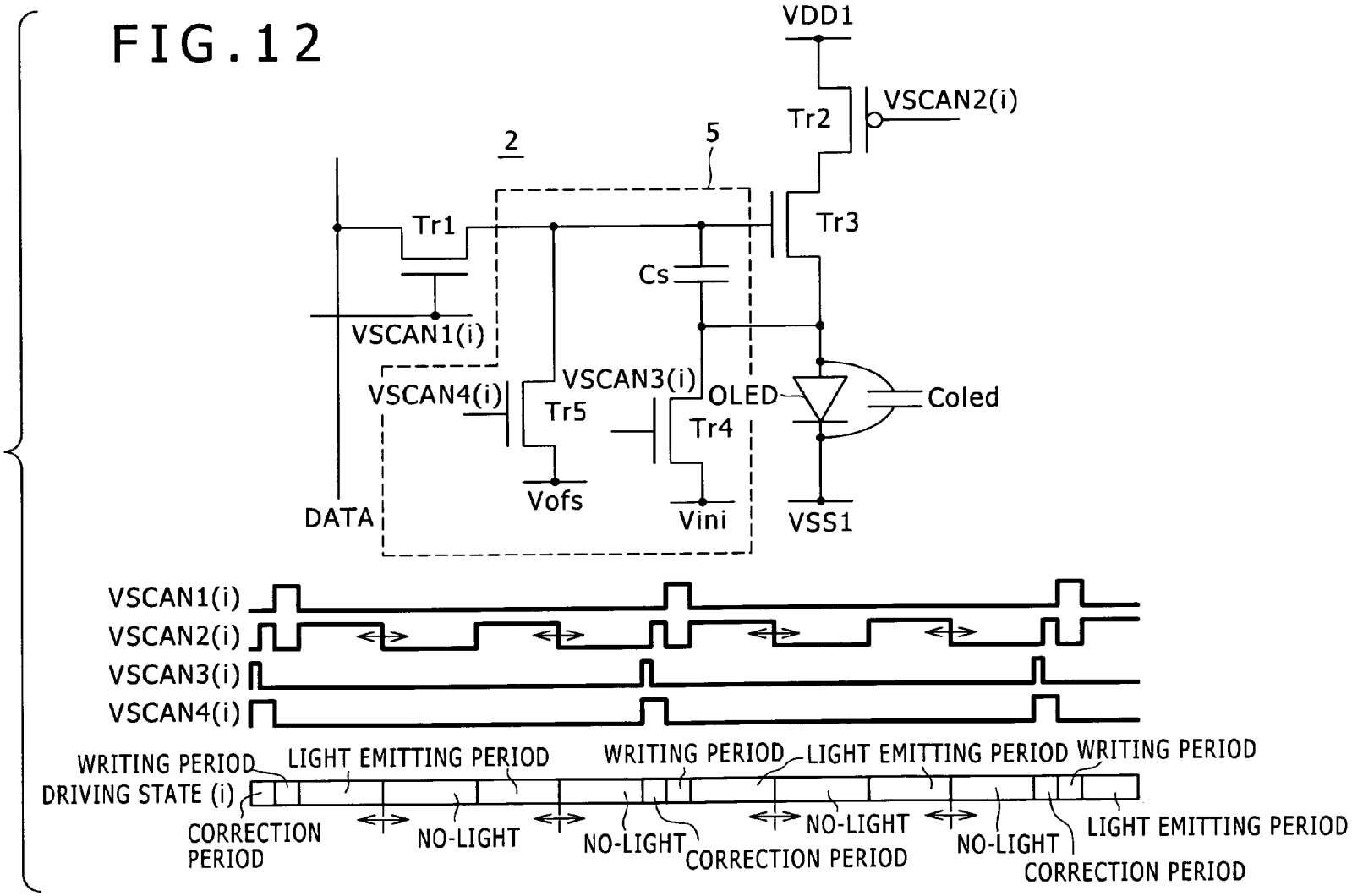

FIG. 12 shows a third form of the pixel circuit. In order to facilitate understandings, representation same as that of the second form shown in FIG. 11 is adopted also in FIG. 12. A configuration of the pixel circuit 2 is shown on the upper side while a timing chart is shown on the lower side in FIG. 12. The present pixel circuit 2 includes a driving transistor Tr3 of the N channel type and is formed as of the voltage writing type similarly to the pixel circuits of the first and second forms described above. Since the driving transistor Tr3 is of the N channel type, the switching transistor Tr2 is inserted on the power supply line VDD1 side.

The additional circuit 5 incorporated in the pixel circuit 2 implements a threshold value correction function of the driving transistor Tr3 and a bootstrap function of the source potential of the driving transistor Tr3. To this end, the additional circuit 5 additionally includes switching transistors Tr4 and Tr5. The switching transistor Tr4 is connected between the source of the driving transistor Tr3 and a predetermined initial potential Vini, and the control signal VSCAN3(i) is applied to the gate of the switching transistor Tr4. The other switching transistor Tr5 is connected between the gate of the driving transistor Tr3 and a predetermined offset potential Vofs, and the control signal VSCAN4(i) is applied to the gate of the switching transistor Tr5. It is to be noted that the pixel capacitor Cs is connected between the gate and the source of the driving transistor Tr3. Further, the equivalent capacitance of the organic EL light emitting element OLED is represented by Coled.

As can been from the timing chart of FIG. 12, the driving state of the pixel circuit 2 includes a correction period in addition to a writing period, a light emitting period and a no-light emitting period. Within the correction period, the control signals VSCAN3, VSCAN4 and VSCAN2 successively change over to the high level to detect and hold the threshold voltage of the driving transistor Tr3 into the pixel capacitor Cs. Consequently, a dispersion of the threshold voltage of the driving transistor Tr3 can be canceled. Further, since the switching transistor Tr4 is turned off when the light emitting period is entered, the gate/source voltage of the driving transistor Tr3 is normally kept fixed by the pixel capacitor Cs. Accordingly, when the light emitting period is entered and the output current flows through the organic EL light emitting element OLED to raise the anode potential of the light emitting element OLED (that is, the source potential of the driving transistor Tr3), a bootstrap operation that also the gate potential of the driving transistor Tr3 rises in an interlocking relationship with such rise is performed. As a result, the output current to be supplied to the light emitting element OLED is typically kept fixed.

Figure 13:
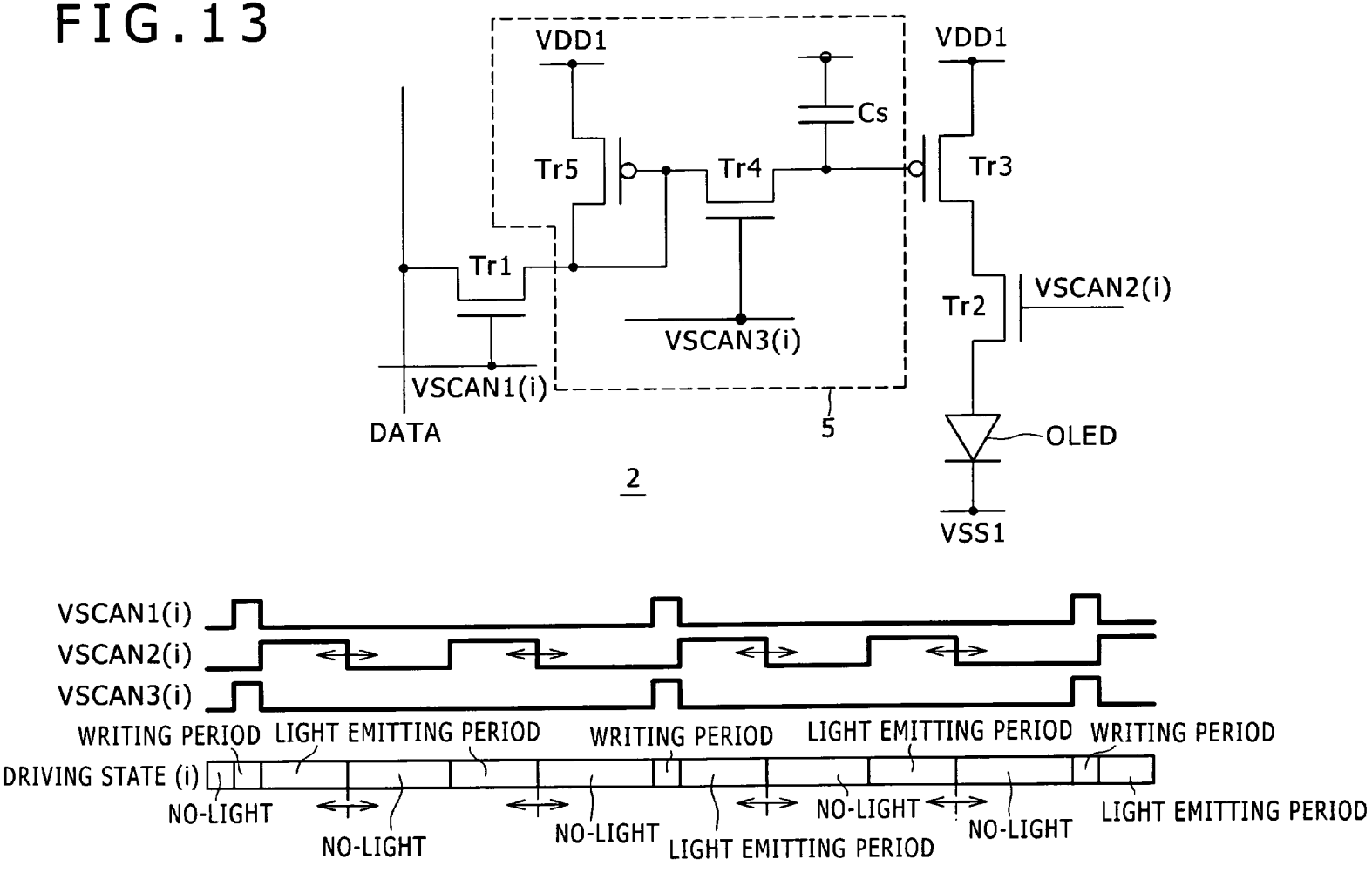

FIG. 13 shows a fourth form of the pixel circuit. In order to facilitate understandings, representation same as that of the preceding forms is adopted also in FIG. 13. A circuit diagram of the pixel circuit according to the fourth form is shown on the upper side while a timing chart illustrating operation conditions is shown on the lower side in FIG. 13. While the pixel circuits of the first to third forms are of the voltage writing type, the pixel circuit of FIG. 13 is of the current writing type which utilizes a current mirror circuit. Referring to FIG. 13, the additional circuit 5 of the pixel circuit 2 shown additionally includes switching transistors Tr4 and Tr5. The switching transistor Tr4 is inserted between the sampling transistor Tr1 and the gate of the driving transistor Tr3, and the control signal VSCAN3(i) is applied to the gate of the switching transistor Tr4. The other switching transistor Tr5 is of the P channel type similarly to the sampling transistor Tr3 and is connected between the power supply line VDD1 and the sampling transistor Tr1. Here, the gates of the driving transistor Tr3 and the switching transistor Tr5 are connected to each other through the switching transistor Tr4, thereby forming a current mirror configuration. In the present pixel circuit 2, signal current corresponding to image signal current flowing through the signal line DATA is caused to flow through the driving transistor Tr3 by the current mirror circuit. By this, a dispersion of the threshold value or a dispersion of the mobility of the driving transistor Tr3 is canceled.

Figure 14:
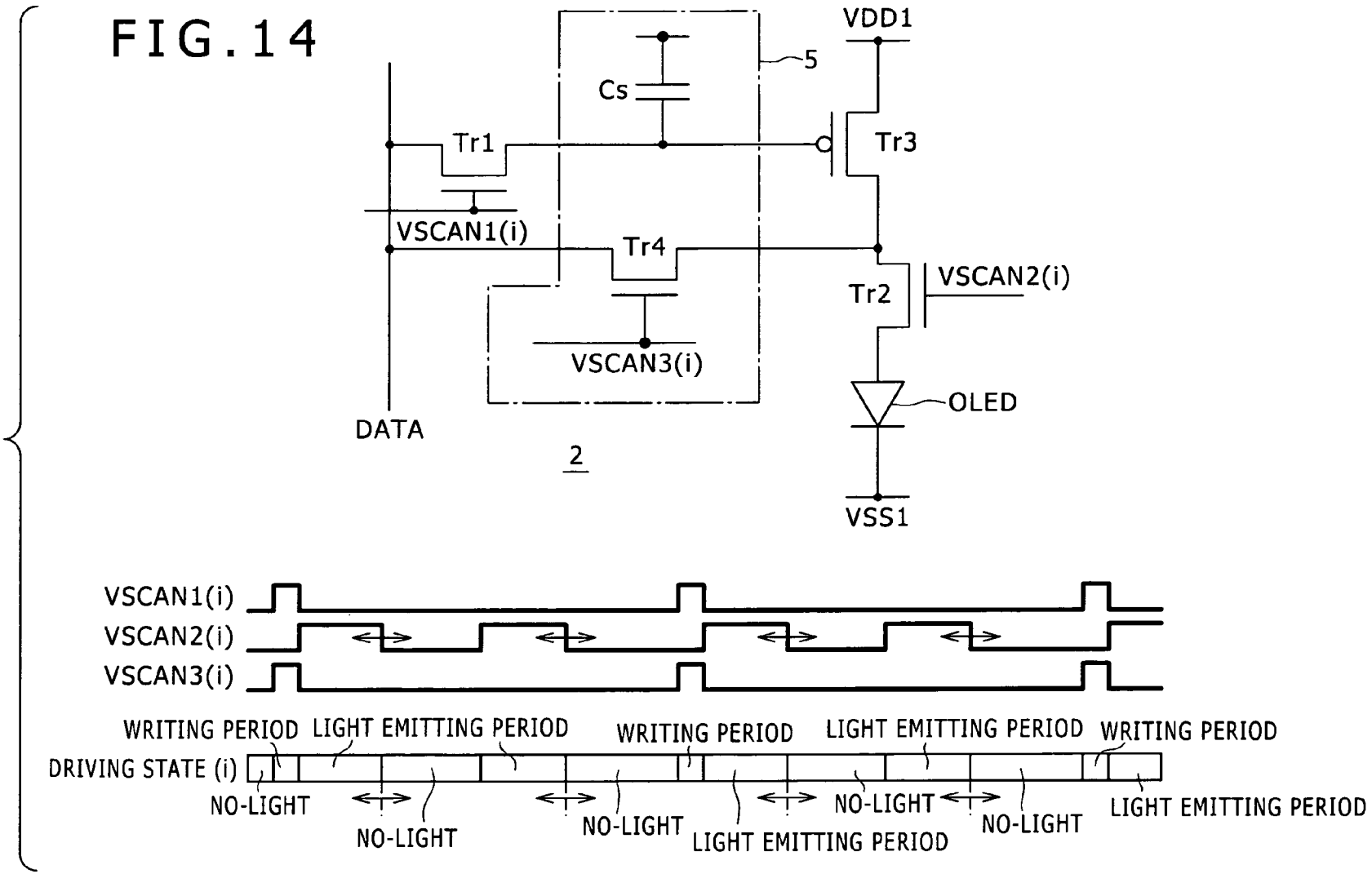

FIG. 14 shows a fifth form of the pixel circuit. In order to facilitate understandings, representation similar to that of the fourth form of FIG. 13 is adopted also in FIG. 14. A configuration of the pixel circuit according to the fifth form is shown on the upper side while a timing chart illustrating operation conditions is shown on the lower side in FIG. 14. The present pixel circuit 2 is of the current copy current writing type. The additional circuit 5 of the pixel circuit 2 additionally includes a switching transistor Tr4 in addition to the pixel capacitor Cs. The switching transistor Tr4 is connected between the signal line DATA and the drain of the driving transistor Tr3, and the control signal VSCAN3(i) is applied to the gate of the switching transistor Tr4. As seen from the timing chart on the lower side in FIG. 14, the pixel circuit 2 successively carries out current copy current writing, emission of light and emission of no light in response to the control signal VSCAN1, VSCAN2 and VSCAN3.

While a preferred embodiment of the present invention has been described using specific terms, such description is for illustrative purpose only, and it is to be understood that changes and variations may be made without departing from the spirit or scope of the following claims.

What is claimed is:

1. An image display apparatus, comprising:

a plurality of scanning lines extending along rows and configured to successively supply a control signal in synchronism with a horizontal period in order to perform line-sequential scanning over one field;

a plurality of signal lines extending along columns and configured to supply an image signal in accordance with the line-sequential scanning; and a plurality of pixel circuits disposed at locations at which said scanning lines and said signal lines intersect with each other and configured to form a screen;

each of said pixel circuits including at least a sampling transistor, a driving transistor, a switching transistor and an electro-optical element, said sampling transistor being rendered conducting in response to a control signal supplied from the associated scanning line in accordance with one horizontal period to sample the image signal supplied from the associated signal line, said driving transistor supplying output current in response to the sampled image signal to said electro-optical element, said electro-optical element emitting light at a luminance according to the image signal with the output current supplied from said driving transistor to display an image on the screen, said switching transistor being disposed on a current path along which the output current flows, said switching transistor being operable to turn on and off in response to another control signal supplied from the associated scanning line such that the output current is interrupted when said switching transistor is in the off state but the output current is supplied, when said switching transistor is in the on state, to said electro-optical element so that said electro-optical element emits light, the light emitting period within which said electro-optical element emits light within one field being controlled to adjust the luminance level of the screen, said switching transistor repeating the turning on and off operations by a plural number of times in response to the control signal supplied from the associated scanning line thereby such that a plurality of light emitting periods within which said electro-optical element emits light are set divisionally within one field and which can be adjusted so as to have different time lengths.

2. The image display apparatus according to claim 1, wherein said switching transistor can adjust the time lengths of the light emitting periods on the real time basis while an image is displayed on the screen.

3. The image display apparatus according to claim 2, wherein said switching transistor adjusts one of the plural light emitting periods by one adjustment unit which corresponds to one horizontal period per one field.

4. The image display apparatus according to claim 2, wherein, when the light emitting periods are varied to adjust the luminance level of the screen for each field, said switching transistor does not vary the time length of at least one of the plural light emitting periods.

5. The image display apparatus according to claim 1, wherein, when the time length of any of the light emitting periods is to be adjusted, said switching transistor sets the difference between different ones of the light emitting periods within one adjustment unit which corresponds to one horizontal period.

6. The image display apparatus according to claim 5, wherein, when the time length of one of the light emitting periods is to be increased while the time lengths of the light emitting periods within one field are equal to each other, said switching transistor preferentially increases the time length of that one of the light emitting periods which is later in time within the field.

7. The image display apparatus according to claim 5, wherein, when the time length of one of the light emitting periods is to be decreased while the time lengths of the light emitting periods within one field are equal to each other, said switching transistor preferentially decreases the time length of that one of the light emitting periods which is later in time within the field.

* * * * *